US005359338A

United States Patent [19]

Hatcher, Jr. et al.

[11] Patent Number: 5,359,338

[45] Date of Patent: Oct. 25, 1994

[54] LINEAR CONFORMAL ANTENNA ARRAY FOR SCANNING NEAR END-FIRE IN ONE DIRECTION

[75] Inventors: Eugene C. Hatcher, Jr.; Mark J. DeHart; Douglas W. Sherman, all of King County, Wash.

[73] Assignee: The Boeing Company, Seattle, Wash.

[21] Appl. No.: 702,452

[22] Filed: May 16, 1991

Related U.S. Application Data

[63] Continuation of Ser. No. 410,088, Sep. 20, 1989, abandoned.

[51] Int. Cl.[5] ..... H01Q 13/00

[52] U.S. Cl. ..... 343/778; 343/754; 343/786

[58] Field of Search ..... 343/705, 776, 778, 786, 343/754, 772, 777,

[56] References Cited

U.S. PATENT DOCUMENTS

| | | | |
|---|---|---|---|
| 2,283,935 | 5/1942 | King | 343/786 |
| 2,423,073 | 6/1947 | Willoughby | 343/786 |
| 2,650,985 | 9/1953 | Rust et al. | 343/786 |
| 2,764,757 | 9/1956 | Rust et al. | 343/783 |
| 2,810,905 | 10/1957 | Barlow . | |
| 3,259,902 | 7/1966 | Malech | 343/777 |
| 3,699,574 | 10/1972 | O'Hara et al. | 343/705 |
| 3,852,748 | 12/1974 | Stark | 343/754 |
| 4,063,248 | 12/1977 | Debski et al. | 343/778 |
| 4,353,074 | 10/1982 | Monser et al. | 343/786 |
| 4,413,263 | 11/1983 | Amitay et al. | 343/778 |
| 4,458,249 | 7/1984 | Valentino et al. | 343/754 |
| 4,490,723 | 12/1984 | Hardie et al. | 343/754 |
| 4,959,658 | 9/1990 | Collins | 343/786 |

*Primary Examiner*—Theodore M. Blum
*Attorney, Agent, or Firm*—Seed & Berry

[57] ABSTRACT

A linear conformal array antenna consisting of double-ridged waveguide elements which are all tapered in the E-plane or the H-plane. The array of waveguide elements is fed by a Gent lens whose amplitude and phase characteristics can be adjusted to cause the waveguide element array to produce a desired radiation pattern. The linear array antenna, which has been tapered in the E-plane, can be operated to scan an electromagnetic endfire beam in one predetermined direction with a maximum scan loss of 3 dB. The array of waveguide elements can be substantially conformal with the fuselage of an airborne craft carrying the linear array antenna, thereby reducing aerodynamic drag and radar cross section. The linear array antenna has a bandwidth that is greater than an octave wide.

21 Claims, 15 Drawing Sheets

LINEAR CONFORMAL ANTENNA ARRAY FOR SCANNING NEAR END-FIRE IN ONE DIRECTION

This application is a continuation of U.S. patent application Ser. No. 07/410,088 filed Sep. 20, 1989, now abandoned

TECHNICAL FIELD

This invention relates to a linear antenna array, and more particularly, to a linear antenna array to be carried aboard an airborne craft and conform to the fuselage of the airborne craft.

BACKGROUND

Modern airborne radar, electronic counter measures and electronic warfare applications frequently call for the ability to transmit/receive a beam of electromagnetic energy within approximately 20 degrees (near end-fire) of the longitudinal axis of the airborne craft carrying the radar, ECM and EW systems. It is also frequently desirable to scan a beam of electromagnetic energy in one direction relative to the antenna's boresight axis, either simultaneously or switchably at electronic speeds. Further, in many applications, it is useful to have an antenna system that can operate over a relatively wide bandwidth, obviating the need for more than one antenna system.

In the past, linear array antennas whose boresight axis was perpendicular to the longitudinal axis of the airborne craft were usable for scanning a beam of electromagnetic energy to end-fire (90 degrees from the antenna boresight axis) because of the excessive loss in antenna gain due to the radiation characteristics of the elements of the array at the scan angles of interest. Hence, attempts to meet such operational requirements have been made by a variety of antenna systems. One such antenna system is a hog-horn antenna, which combines a horn antenna with a section of a parabolic reflector. A hog-horn antenna is typically shrouded in a blade-shaped radome which is mounted on the exterior of the fuselage of the airborne craft. In this configuration, the hog-horn antenna both adds aerodynamic drag to the airborne craft and contributes significantly to the reflective radar cross section of the airborne craft.

In another antenna, an array of eight or more vertically polarized radiators can be used to scan an antenna beam electronically between 20 and 30 degrees from the longitudinal axis of the airborne craft. This array produces a desirable cosecant radiation pattern in the elevation angle, controlling the fall-off rate of the elevation radiation pattern near the airborne craft's longitudinal axis. However, a vertically stacked waveguide array does not provide broad bandwidth coverage and suffers from high voltage standing wave ratio (VSWR) characteristics, which contribute to inefficient transmission of electromagnetic energy. Further, such a stacked waveguide array is mounted in a blade-shaped radome and is also characterized by high aerodynamic drag and an undesirably large radar cross section.

In another approach, cavity-mounted sectoral E-plane horns have been developed to increase the operational bandwidth while reducing tile radar cross section and VSWR. Such horns are typically very long relative to their aperture, which is covered by a dielectric or metal lens. This is necessary to control the rate at which the phase of the electromagnetic energy tapers across the horn aperture. The phase taper, in turn, controls the side lobes of the antenna radiation pattern. Therefore, the use of sectoral E-plane horns is hampered by their physical size requirements.

Accordingly, it is desirable to have an antenna system which can be made conformal to the fuselage of the airborne craft while producing an electromagnetic energy beam which can be directed to within 30 degrees of the airborne craft's longitudinal axis.

DISCLOSURE OF THE INVENTION

It is an object of the present invention to provide a linear antenna array which can be made conformal to the longitudinal axis of an airborne craft.

It is another object of the present invention to provide a linear conformal antenna array which can transmit/receive an electromagnetic beam within 10 degrees (80 degrees from its boresight axis) in one direction with minimum loss in gain as a result of scanning the antenna array's electromagnetic beam.

It is a further object of the present invention to provide a linear conformal antenna array having a controllable radiation pattern.

It is a still further object of the present invention to provide a linear conformal antenna array capable of producing an antenna radiation pattern having low side lobes.

It is yet another object of the present invention to provide a linear conformal antenna array that can produce multiple simultaneous beams or electronic switchable beams.

It is an additional object of the present invention to provide a linear conformal antenna array having a reduced radar cross section.

A still further object of the present invention is to provide a linear conformal antenna array having an operational bandwidth which exceeds one octave.

According to one aspect of the invention, a linear antenna array can comprise a plurality of double ridged rectangular waveguide antenna elements, each having an input end and an output end. Each of the elements includes a corresponding first pair of opposing waveguide walls and a corresponding second pair of opposing waveguide walls. Each element is capable of directing electromagnetic energy comprising orthogonal electric E-plane) and magnetic (H-plane) fields, the electric fields being substantially parallel to the first pair of walls (narrow dimension) and the magnetic fields being substantially parallel to the second pair of walls (wide dimension). One of the pairs of walls at the output end of each element is tapered along a plane that is perpendicular to that pair of walls and at an acute angle to the other pair of walls. The double ridged rectangular waveguide antenna elements are linearly arrayed so that corresponding pairs of opposing waveguide walls (E-plane) are coplanar.

In one embodiment, the waveguide elements are both tapered and arrayed in the plane of the electric field. In a second embodiment, the waveguide elements are tapered in the direction of the magnetic field and arrayed in the direction of the electric field.

According to another aspect of the invention, an airborne craft having a fuselage is used for transmitting electromagnetic energy in a predetermined direction relative to the longitudinal direction of the airborne craft. The airborne craft includes a linear array of antenna elements conformal to the fuselage. The linear array includes a plurality of rectangular waveguide antenna elements, each including two pairs of opposing waveguide walls. One pair of waveguide walls of each element is tapered along a plane that is perpendicular to that pair of walls and at an acute angle to the other pair of walls. The rectangular waveguide antenna elements are linearly arrayed so that corresponding pairs of opposing waveguide walls are coplanar.

According to another aspect of the invention, a linear array of antenna elements can comprise a plurality of substantially identical antenna elements. Each antenna element can have an input end, an output end, a boresight, and a radiation pattern producing a maximum value at an angle spaced away from the boresight of the antenna element by a predetermined angle. The linear array of antenna elements can direct energy comprising orthogonal electric and magnetic fields in a predetermined direction substantially in a range of 0 to 90 degrees.

BEST MODE FOR CARRYING OUT THE INVENTION

Figure 1:
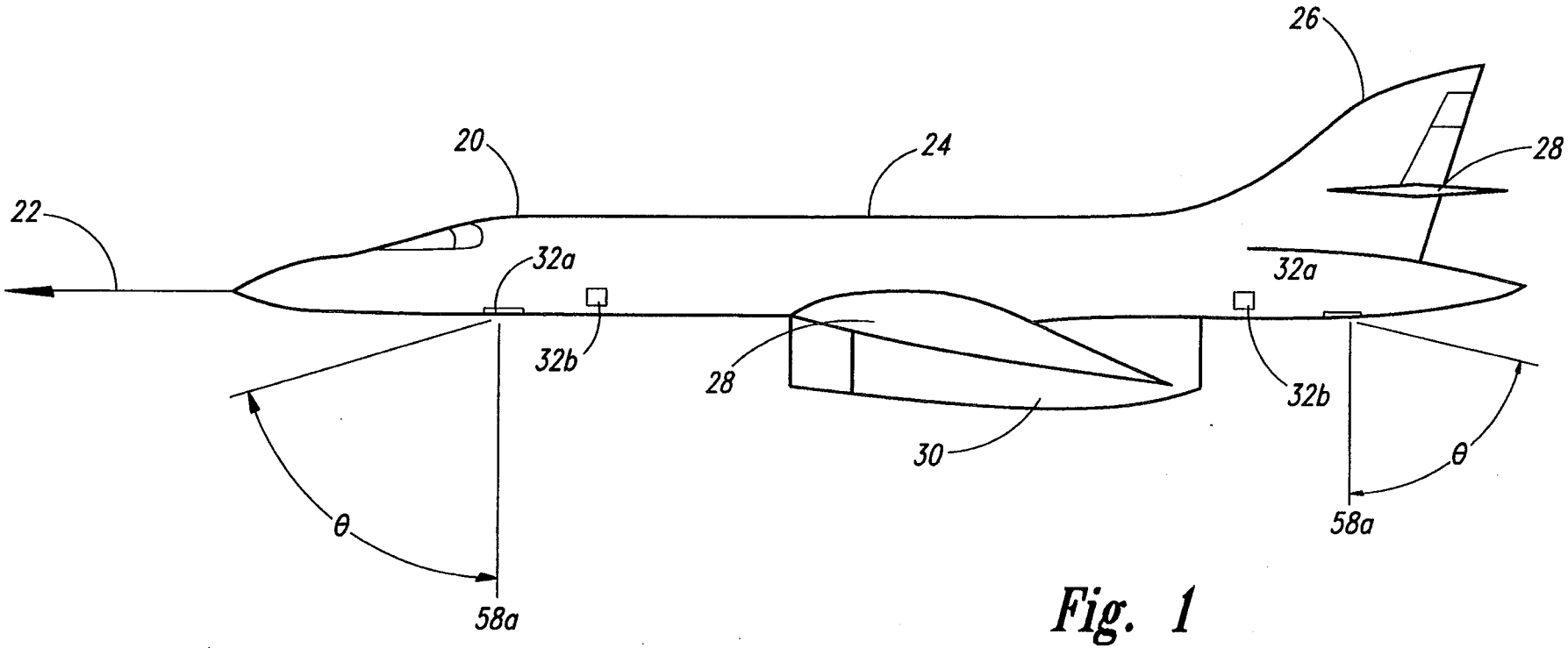
FIG. 1 is a schematic diagram of an airborne craft carrying linear conformal antenna arrays of the present invention.

Referring to FIG. 1, an airborne craft 20, such as an airplane, has a longitudinal axis, indicated by arrow 22. The airborne craft 20 includes a fuselage 24 and control surfaces, such as vertical stabilizer 26, horizontal control surfaces 28, and engines 30.

The airborne craft 20 includes a variety of sensors which require antenna systems to receive and transmit electromagnetic energy at radio and microwave frequencies. These antennas can take the form of conformal arrays **32*a* and 32*b***.

The conformal arrays 32a are mounted on undersurfaces of fuselage 24 and can be used to transmit or receive electromagnetic energy from below the aircraft at a scan, or elevation, angle of 80 degrees with respect to a perpendicular line drawn through the conformal array **32*a* at the fuselage 24. The scan angle $\theta$ can range from zero degrees to more than 80 degrees. A boresight of an antenna array 32*a* or 32*b*** is orthogonal to the fuselage at the location of the antenna array. An antenna array which can transmit or receive electromagnetic energy at angles $\theta$ which approach 90 degrees is said to be an "endfire" antenna array.

Conformal arrays **32*b*, which are mounted on the side, or vertical surfaces, of the fuselage 24, can be used to transmit energy horizontally and down, either transversely to the direction of the arrow 22, or forward or aft with respect to the direction of the arrow 22. In particular, the forward conformal array 32*b* can be designed to transmit one or more beams of electromagnetic energy transversely to the direction of the arrow 22 and at a selectable roll angle downward or forwardly, at an angle that is restricted to the squint by the H-plane cut asymmetrical waveguide. The aft conformal array 32*a* can transmit energy transversely to the direction of the arrow 22 and at a selectable roll angle downward restricted to the squint of the H-plane cut asymmetrical waveguide that has been installed at a reverse angle to the forward looking antenna 22**.

Figure 2:
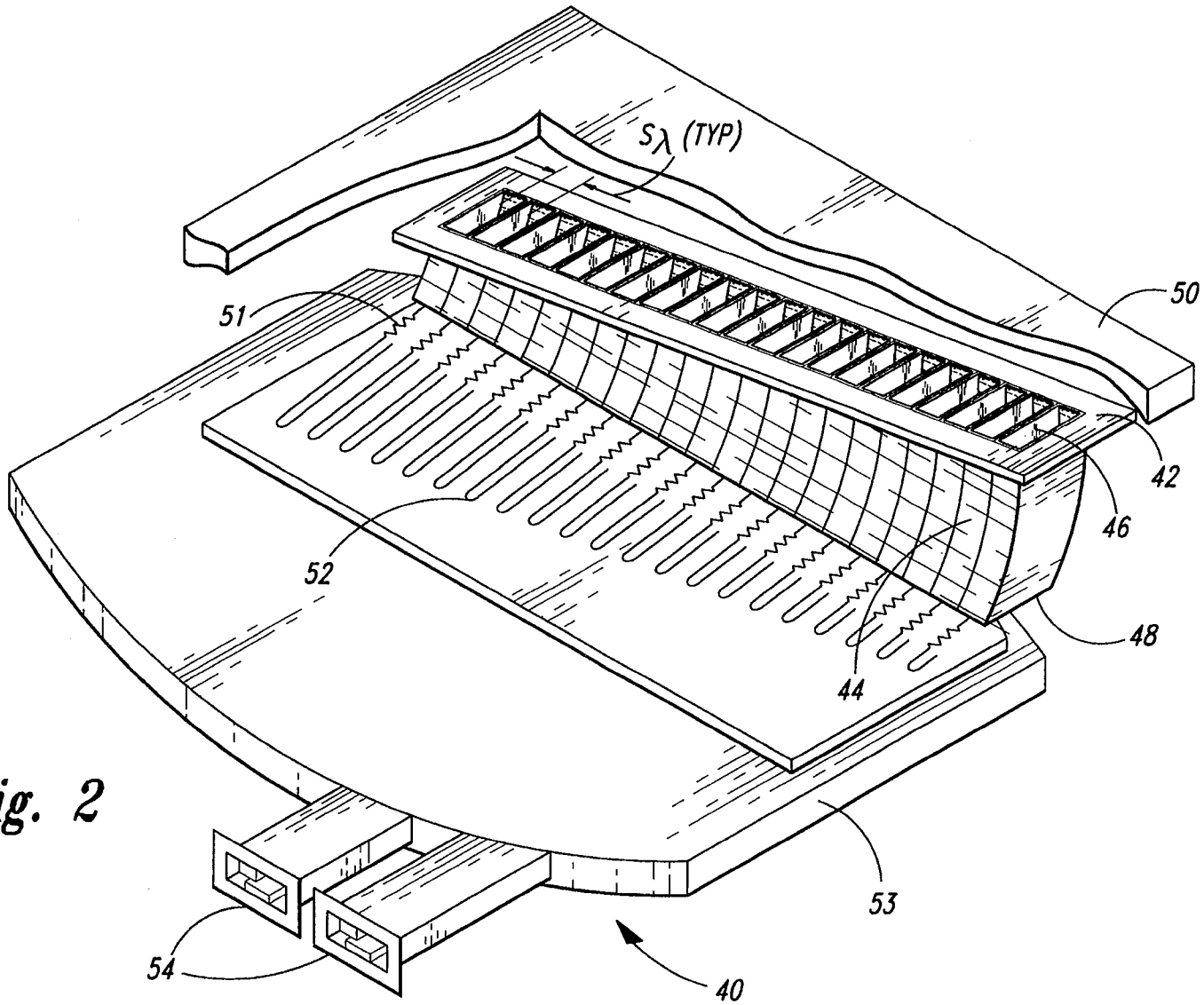
FIG. 2 is a perspective drawing of a first embodiment of the invention.

FIG. 2 is an isometric drawing of a first embodiment of the invention. The endfire antenna 40 includes a linear array 42 of waveguide elements 44, such as twenty-two double-ridged waveguide elements spaced by a distance S $\lambda$, and arranged so that the electric fields that each waveguide element supports are parallel to the length of the linear array 42.

The double-ridged waveguide elements provide a bandwidth of one octave, which is particularly desirable. However, other waveguide structures, such as rectangular waveguides can also be used to provide the same off-boresight performance without the augmented bandwidth.

The open output ends of each of the double-ridged waveguide elements 44 are defined by two pairs of parallel waveguide walls. One pair of waveguide walls is perpendicular to the direction of the linear array 42, while the other pair of waveguide walls is parallel to the direction of the linear array 42. Each of the waveguide elements 44 is made from a conductive metal. Each waveguide elopement 44 has an essentially rectangular cross section between the output end 46 and the input end 48.

The output ends 46 of the waveguide elements 44 can be covered by a cover 50 which can be made from fiberglass and Nomex®, or some other material (low observable frequency selective surface) which is transparent to electromagnetic energy at radio and/or microwave frequencies. When the endfire antenna 40 is installed in the airborne craft 20 (see FIG. 1), the cover 50 conforms to the outer shape of the fuselage 24, thereby reducing aerodynamic drag of the airborne craft to the level it would be if the antenna were not placed in the fuselage.

The input end 48 of each of the waveguide elements 44 is attached to a microstrip transmission line 52. Fixed value attenuators 51 are inserted between the waveguide input 48 and to provide the amplitude taper (FIG. 8) that is required to produce the sidelobe levels desired in the elevation plane radiation pattern. The microstrip transmission lines 52 are part of the symmetric Gent lens 53. The symmetric Gent lens 53 receives the radio frequency and/or microwave energy through one or more beam ports 54, which are attached to its "beam ports". If desired, this energy can be transmitted to the Gent lens 53 through more than one beam port in order to cause the endfire antenna 40 to simultaneously produce more than one beam of electromagnetic energy. Alternatively, if desired, the radio frequency and/or microwave energy can be electronically switched among two or more beam ports 54, thereby providing for a switchable beam. The operation of the Gent lens with the inventive antenna is described below.

Figure 3:
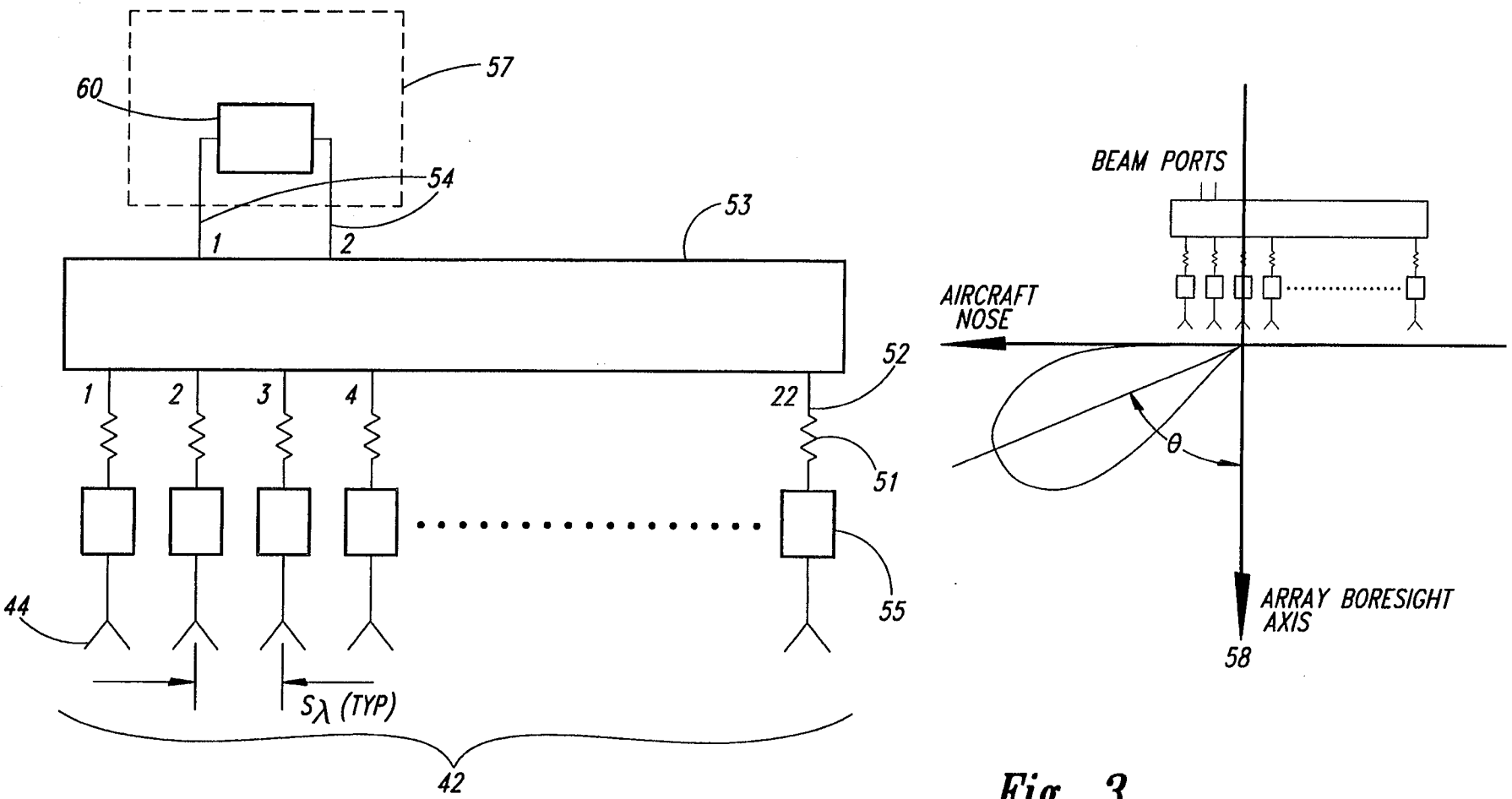
FIG. 3 is a block diagram of an antenna system according to the present invention.

FIG. 3 is a block diagram of the endfire antenna 40. The transmission circuit includes a Gent lens 53, phase correcting transmission lines, and either fixed value attenuators 51 or power amplifiers 55, and a series of means 52, one for each of the waveguide elements 44 from the Gent lens 53, via the beam ports 54. The beam ports 54 electronically controlled by a computer system 57, which can dynamically alter the phase of the electromagnetic energy passing through to any one of the waveguide elements 44. An elevation (pitch plane) scan angle, $\theta$, designates the angle of rotation about the boresight axis 58, can be as large as 80 degrees.

As will be described subsequently, the waveguide elements 44 of the endfire antenna 40 can be designed to cause the endfire antenna 40 to transmit an endfire beam at an angle of 80 degrees or more from the boresight axis 58 of the linear array 42. The Gent lens 53 can be fed simultaneously or alternatively through the beam ports 54 through the actions of a switch 60, such as a single-pole, multiple-throw waveguide switch. Using the transmission means 52, a Gent lens 53, the action of the switch 60 can cause the entire antenna 40 to transmit two or more simultaneous beams at various scan angles.

Figure 4B:
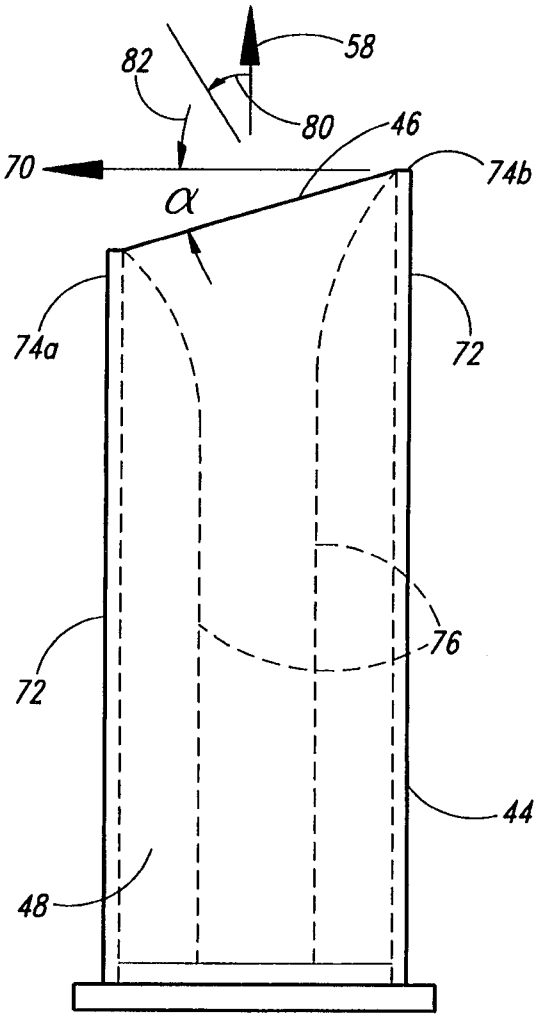
FIG. 4B is a side view of the first embodiment of the present invention, taken in the direction of the E-plane waveguide cut.
Figure 4A:
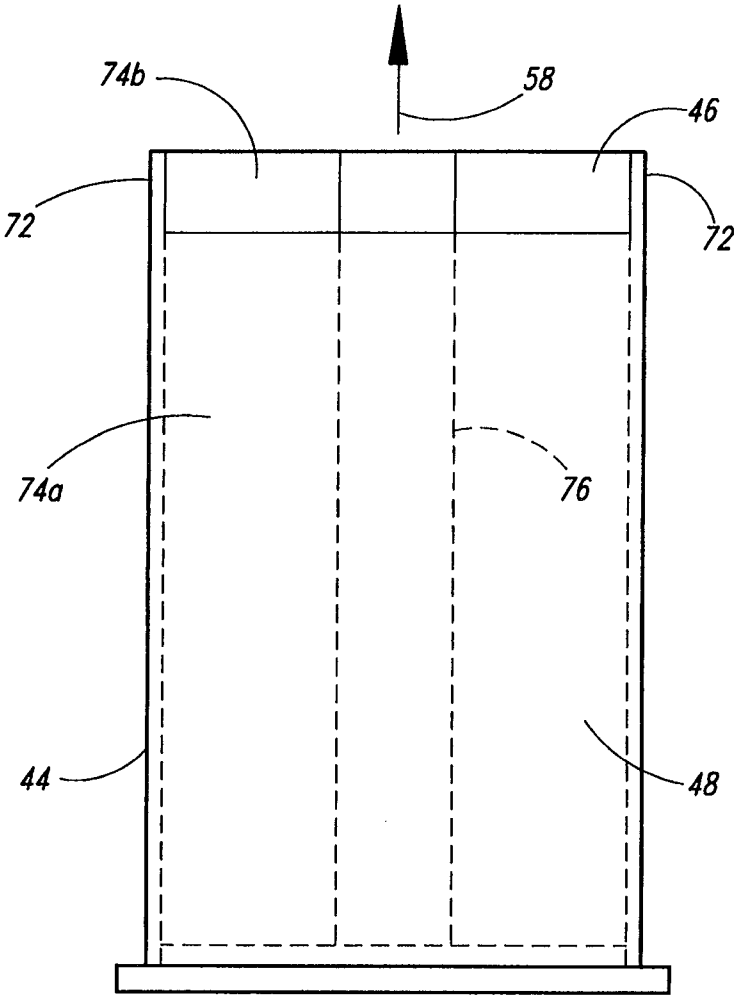
FIG. 4A is an aperture elevational view of an asymmetrical-cut double ridged waveguide element according to the first embodiment of the present invention, taken in the direction of the electric field plane.

FIGS. 4A and 4B are aperture views of a double-ridged waveguide element 44, respectively viewed in the direction of the electric (E-) field and the magnetic (H-) field. The direction of the linear array 42 (see FIG. 2) is indicated by the arrow 70. Each of the double-ridged waveguide elements 44 transmits or receives electromagnetic energy which is polarized so that the direction of the E-field is substantially in the vertical plane defined by the arrow 70. Accordingly, the direction indicated by the arrow 70 is referred to as being in the E-plane. The H-field transmitted by each of the double-ridged waveguide elements 44 is perpendicular to the E-field and, accordingly, is perpendicular to the direction indicated by the arrow 70.

Each of the double-ridged elements 44 is composed of a substantially rectangular cross section tube defined by two pairs of waveguide walls. One pair of waveguide walls 72 is parallel to the direction of the electric field. The other pair of waveguide walls **74*a* and 74*b* is perpendicular to the direction of the magnetic field 70. The waveguide wall 74*a* is shorter than the waveguide wall 74*b*. The waveguide walls 72, which connect between the waveguide walls 74*a* and 74*b*, are linearly tapered at an angle $\alpha$, from the direction of the arrow 70. They define a tapered angle 82 ($\measuredangle$) with respect to the direction of the arrow 70. As a result of the taper of the walls 72 between the waveguide walls 74*b* and 74*a*, each of the waveguide elements 44 exhibits the ability to transmit electromagnetic energy at a scan angle 80 that does not coincide with the boresight angle 58. Further, the relative gain of each of the waveguide elements 44 is a function of the tapered angle 82 ($\alpha$). The waveguide elements 44 include conductive ridges 76, which will enable the waveguide elements 44** to operate over an octave bandwidth.

Figure 5A:
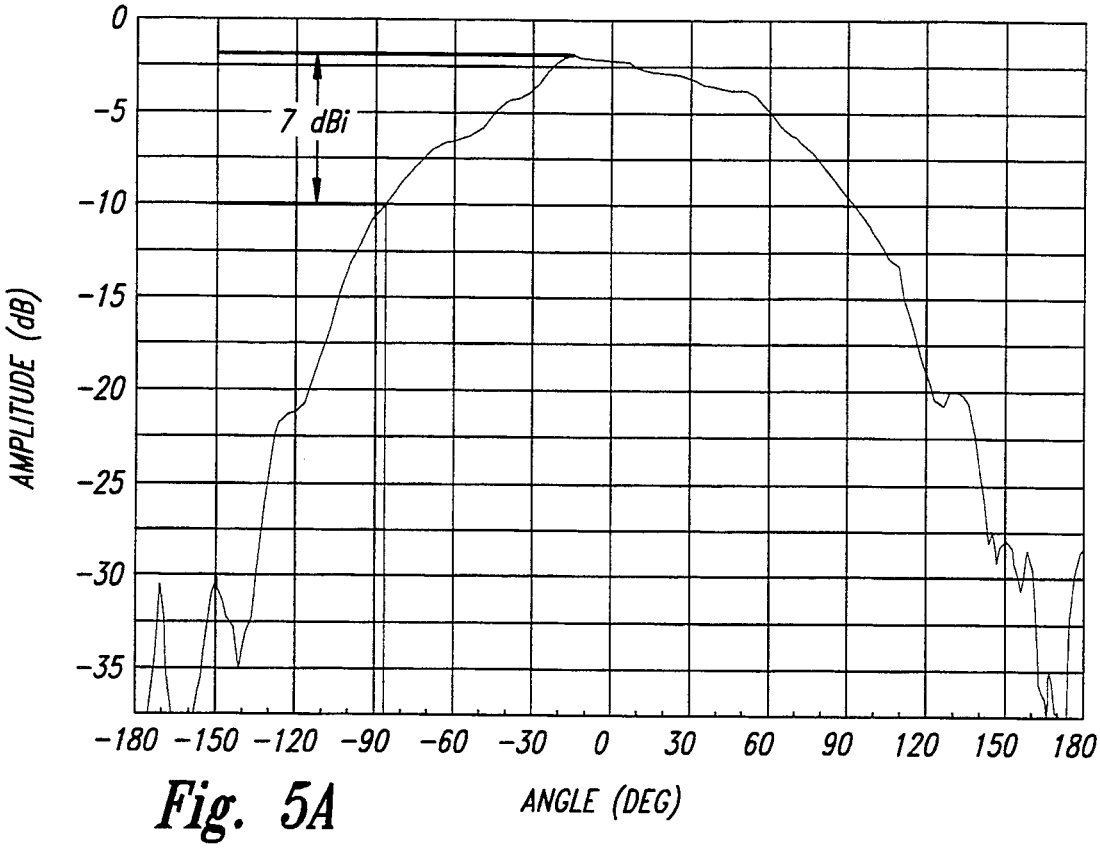
FIG. 5A is an antenna radiation pattern of the first embodiment of the present invention, taken in the electric field (E-) plane at a cut of 0 degrees.
Figure 5B:
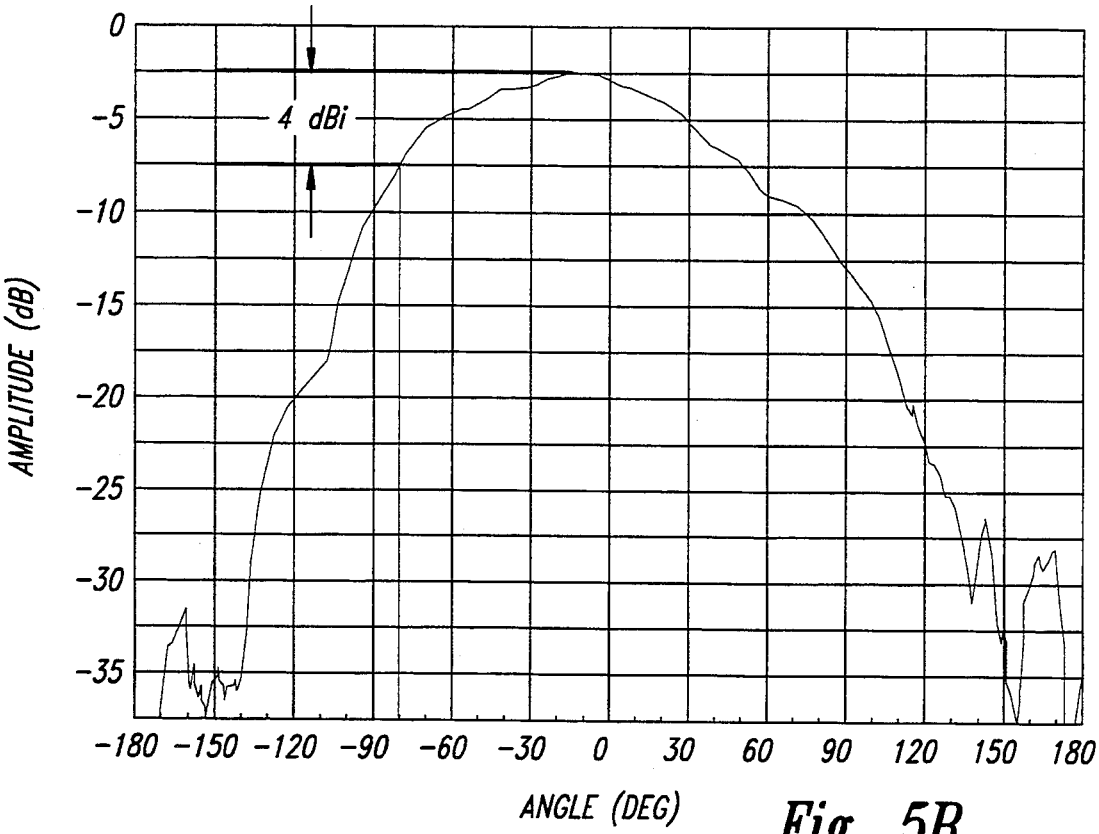
FIG. 5B is an antenna radiation pattern of the first embodiment of the present invention, taken in the electric field (E-) plane at a cut of 20 degrees in the E-plane.
Figure 6A:
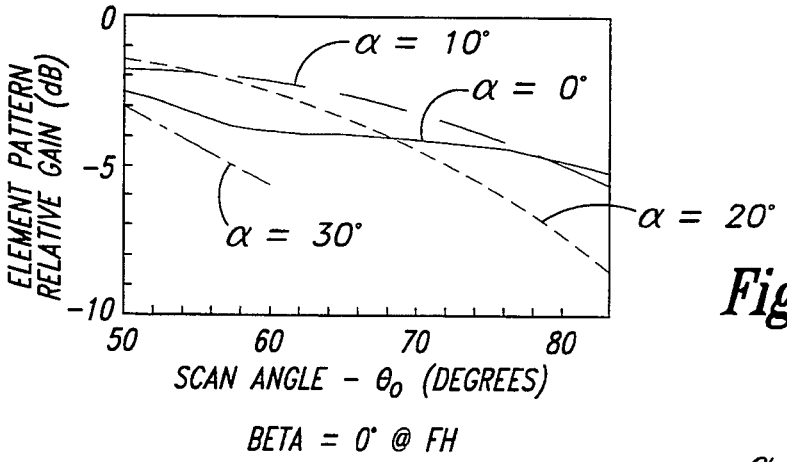
FIG. 6 is a graph of the antenna relative gain of a single waveguide element, as shown in FIGS. 4A and 4B, for various taper angles, $\alpha$, and array tilt angle $\beta$.
Figure 6B:
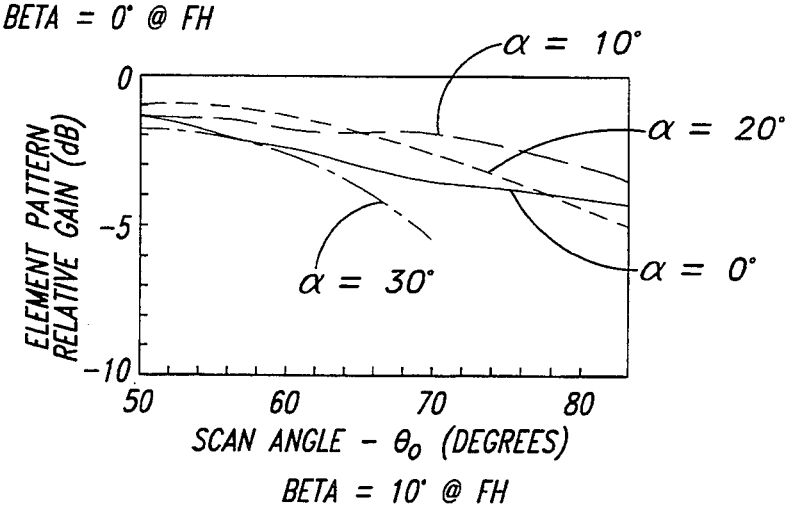
Figure 6C:
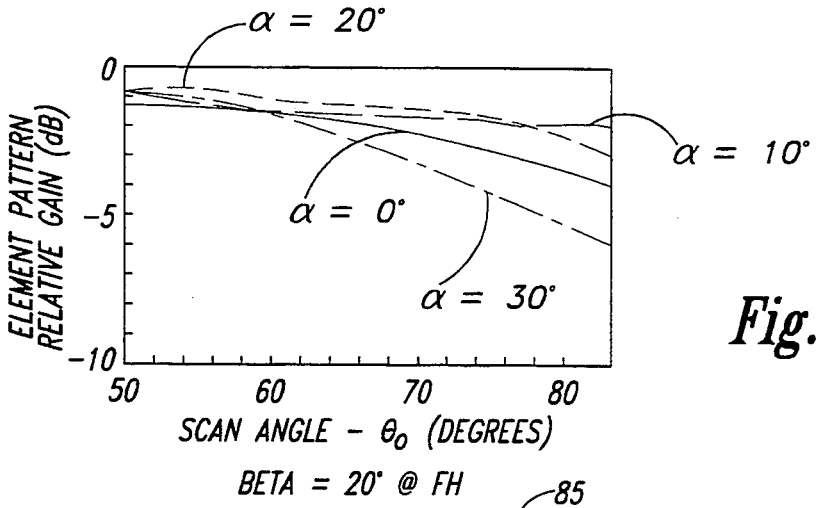
Figure 6D:
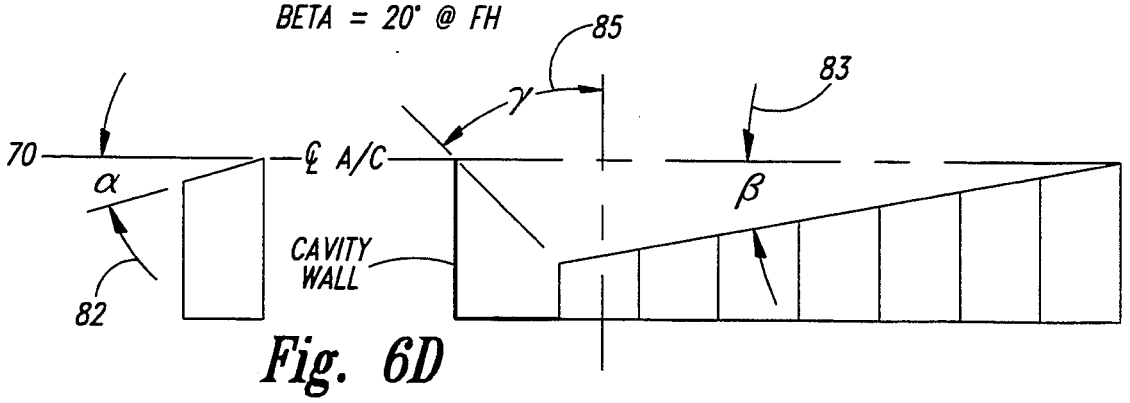

FIGS. 5A and 5B are graphs of the antenna radiation pattern of a double-ridged waveguide with (FIG. 5A) and without (FIG. 5B) a cut in the E-plane of the double-ridged waveguide. The relative decrease in gain from the peak of the beam at an angle 80 degrees from the boresight axis of 44 (0 degrees) is −7 dBi for the symmetrical double-ridged waveguide and −4dBi for the 20 degree cut E-plane asymmetrical waveguide. Hence since the gain loss for a scanning phased array antenna is proportional to the fall off in gain for an coupled individual element in the array, the utilization of an asymmetrical waveguide element can enhance the antenna array gain by a factor of 3dBi or 100 percent.

FIG. 6 is a graph of the relative element pattern gain as a function of angular cut ($\alpha$) in the E-plane of the double-ridged waveguide and the array tilt angle 83 ($\beta$)

It has been found advantageous to produce an endfire antenna 40 (see FIG. 2) composed of individual waveguide elements 44 having a taper angle 82 of approximately 10 degrees. At this value of taper angle 82, the relative gain of each of the waveguide elements 44 in the scan angle range between 60 and 80 degrees is between −1.5 and −2.5 dB.

Figure 7B:
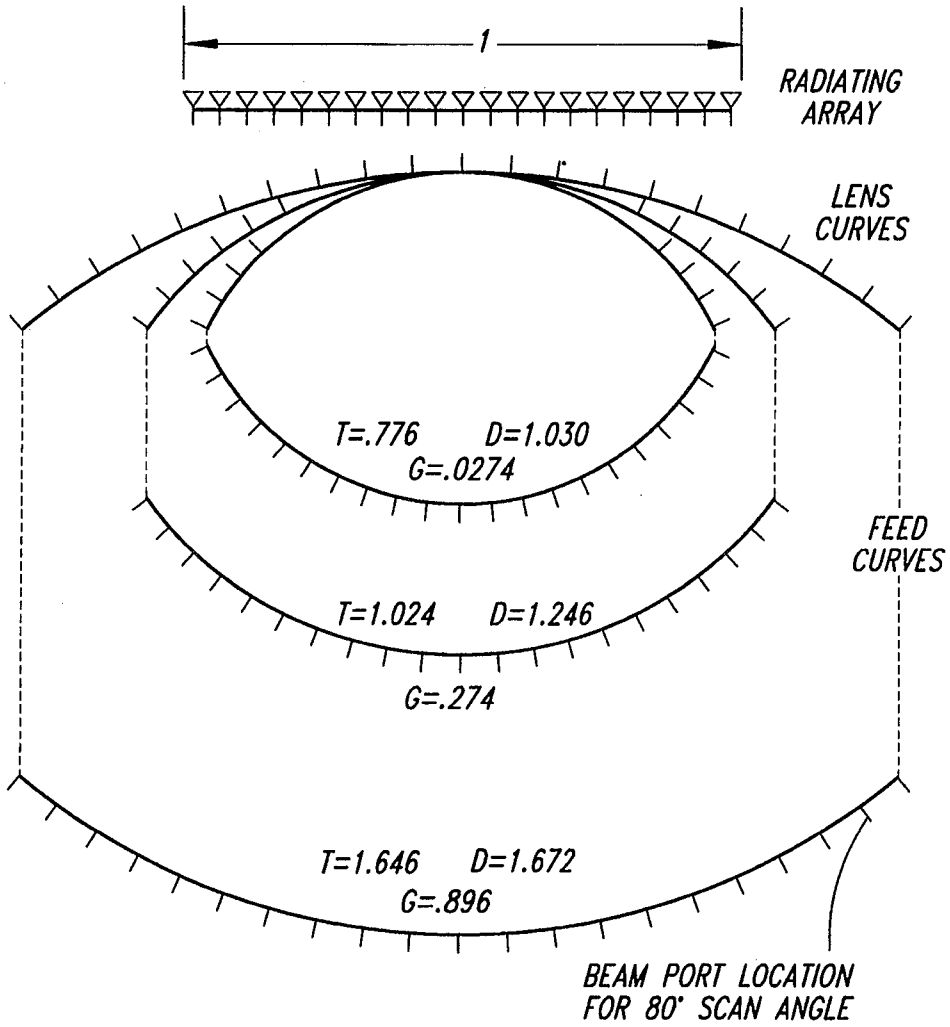
FIG. 7B is a schematic diagram of three configurations of Gent lenses that are useful with the first embodiment of the present invention.
Figure 7A:
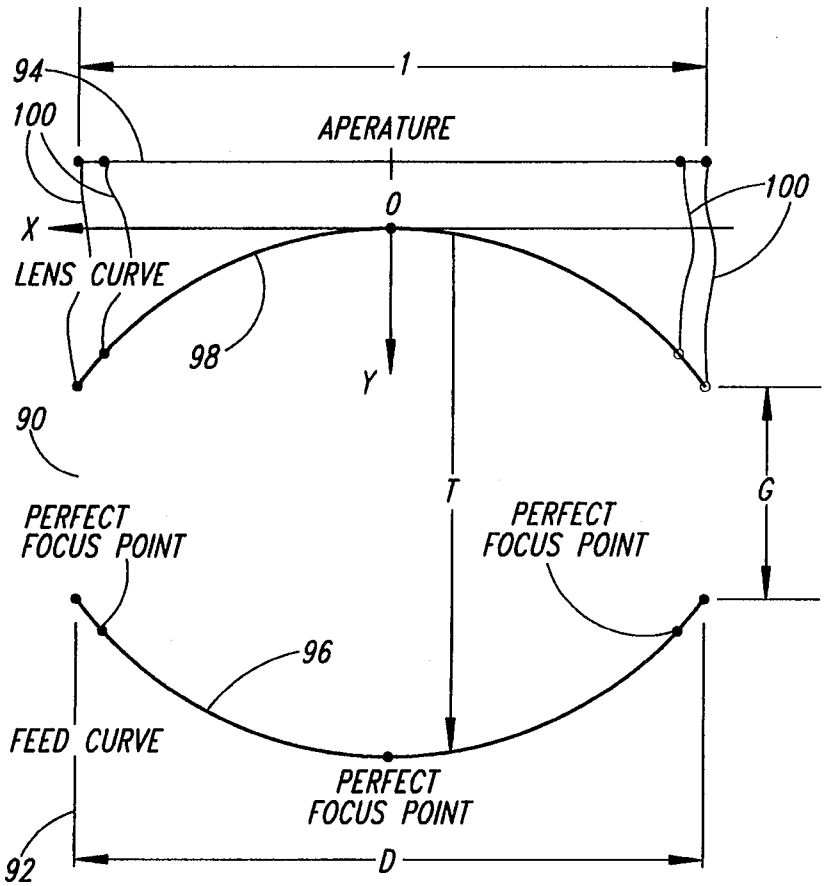
FIG. 7A is a schematic diagram of a symmetric Gent lens, which is used with the linear conformal antenna array of the present invention.

FIG. 7A is a schematic diagram of a symmetric Gent lens which is used with the linear conformal array antennas of the present invention. This Gent lens is capable of producing a phase taper which will allow an antenna array to scan through an angle of ±90 degrees. The Gent lens 90, which is the transmission means 53, shown in FIGS. 2 and 3, consists of a feed side 92, an aperture side 94, and transmission lines 100. The feed side 92 defines a feed curve, along which an array of feed points can be located. Electromagnetic energy received at the feed side 92 is transmitted through the feed curve and onto the aperture side 94.

The geometries of the feed curve 96, the corresponding lens curve 98, and the lengths of the transmission lines 100 are selected so that the phase of the electromagnetic energy received at the aperture 94 as a result of being transmitted from a particular point on the feed curve 96 will exhibit a desired phase taper. For example, at three points along the feed curve 96, the so-called "perfect" focus points, the electromagnetic energy transmitted will be received with a linear phase taper at the aperture. At other points along the feed curve 96, other desired responses can be obtained. In particular, the feed curve 96, the lens curve 98, and the transmission lines cables 100 can be tailored to cause the transmitted electromagnetic energy to have phase characteristics which cause the linear array 42 to transmit primarily in a particular desired direction.

FIG. 7B is a schematic diagram of three configurations of Gent lenses that are useful with the first embodiment of the present invention. Each of these curves is normalized to the width of the aperture of the linear array 42 (see FIG. 2). The feed curve 96 and lens curve 98 can be separated by a distance (T) which ranges from less than to more than the aperture length. The gap (G) between the two ends of the feed and lens curves 96 and 98 can range from a negligible distance to a distance approximately equal to the length of the aperture. The width (D) of the feed side 92 is generally chosen to be no less than the length of the linear array 42.

Figure 8:
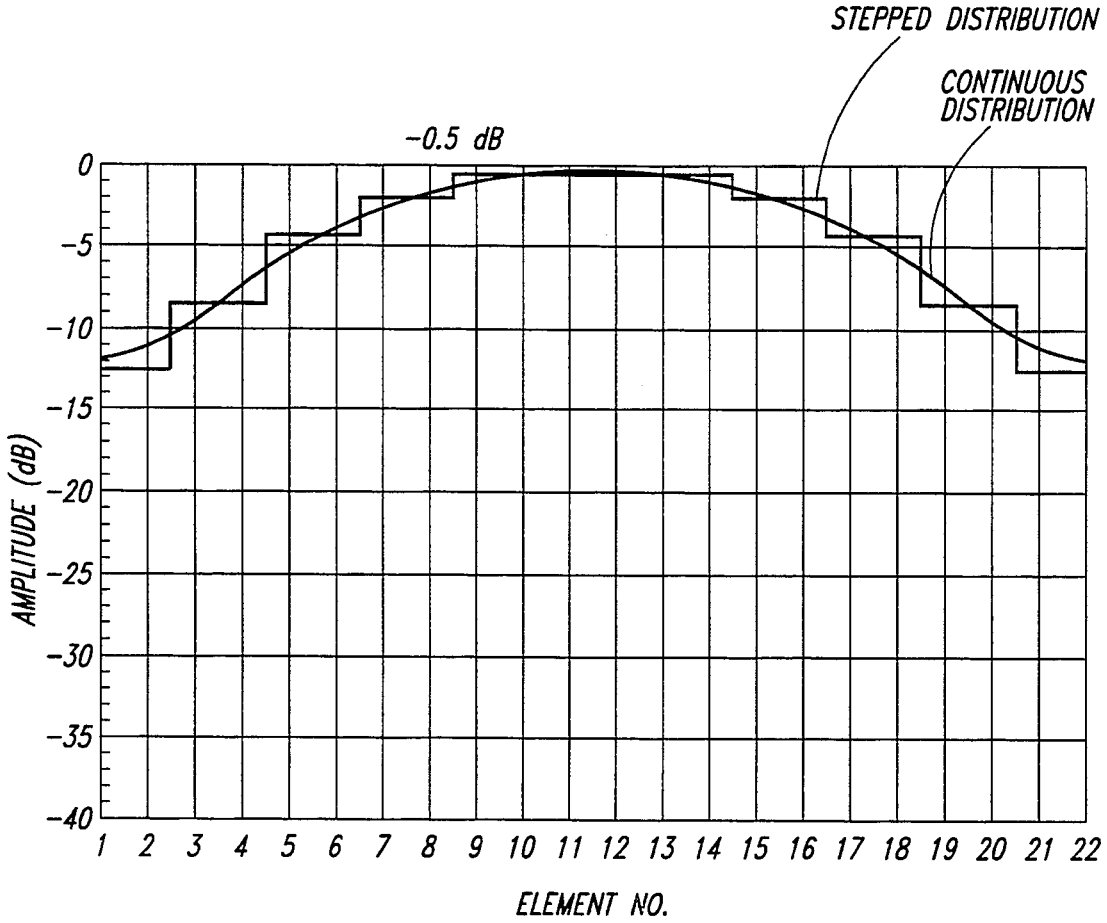
FIG. 8 is a graph of an amplitude distribution which is useful with the first embodiment of the present invention.

An example of a desirable attenuation distribution for the attenuators 51 shown in FIGS. 2 and 3 is illustrated in the graph of FIG. 8. The amount of attenuation in each of the attenuators 51, corresponding to the twenty-two waveguide elements 44, is a staircase function approximation of a continuous amplitude distribution which gives rise to an amplitude distribution known as the "Faylor amplitude distribution." The Taylor amplitude distribution exhibits first side lobes which are 30 dB below the level of the main antenna beam, fulfilling one of the desired characteristics of an endfire antenna. This desired characteristic is that virtually all of the energy received by the antenna system is received through the main lobe, giving a relatively high angular accuracy to the linear array 42 of the endfire antenna 40.

Some conditions can be placed on the desired performance of the linear conformal array of the present invention. The gain of the antenna array is given (when $S_\lambda \leqq 0.5$) by $$G_A = \eta N G_e(\theta, \phi),$$

where $\eta$ is the efficiency of the array, N is the number of waveguide elements, and $G_e(\theta, \phi)$ is the gain of a single element, as a function of the elevation and azimuth angles. The efficiency, $\eta$, is a function of losses due to the amplitude error, phase error, and amplitude taper. The element gain is $$G_e(\theta,\phi) = (4\pi A/\lambda^2)\cdot\cos(\theta[1 - |R(\mu,\nu)|^2]),$$

and $$A/\lambda^2 = (S_x/\lambda)\cdot(S_y/\lambda)$$

(for a two-dimensional array), where $R(\mu,\nu)$ = reflection coefficient associated with the active element impedance and $\mu$ and $\nu$ are the phases between excitation of adjacent elements (in orthogonal directions) which produce radiation by the array in the $\theta$ and $\phi$ directions.

A second condition, $S \leqq \lambda/(1+\sin\theta_0)$, is to prevent grating lobes from entering the visible space of the array, where S is the spacing of adjacent elements, $\theta_0$ is the scan angle of interest, and $\lambda$ is the shortest wavelength in the operational bandwidth.

Figure 9A:
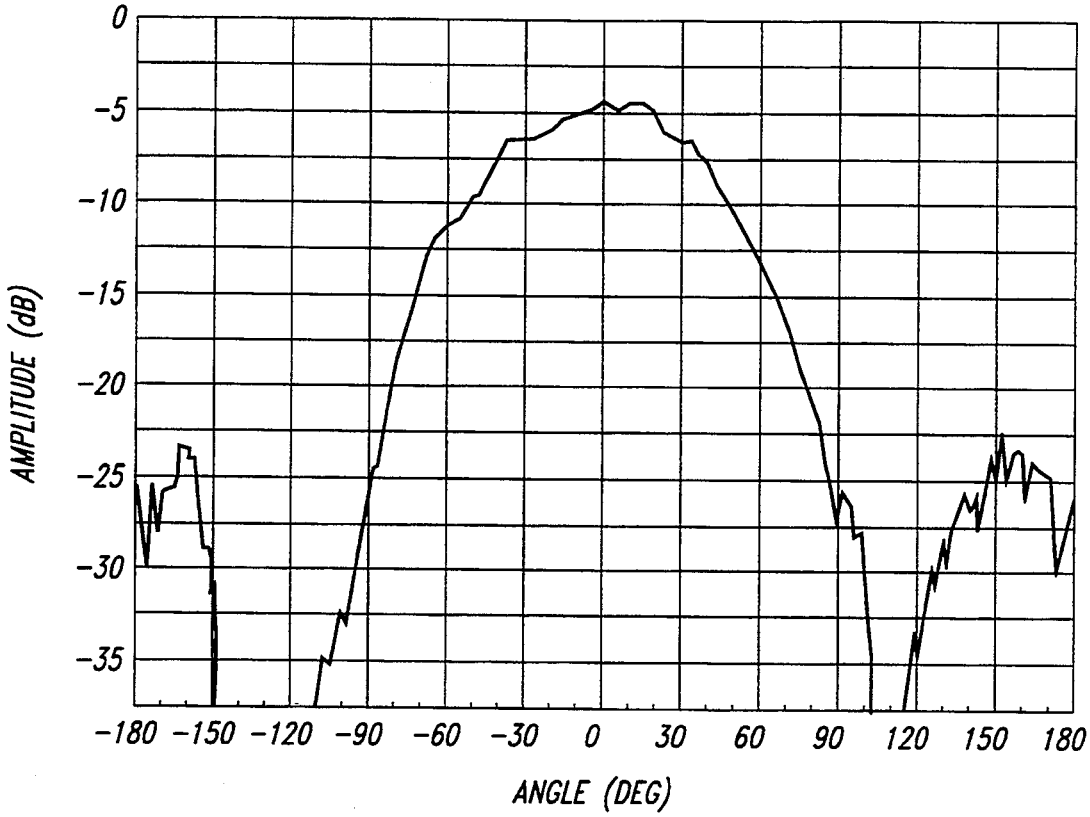
FIG. 9A is an elevation (pitch-plane) coverage radiation pattern of the present invention.
Figure 9B:
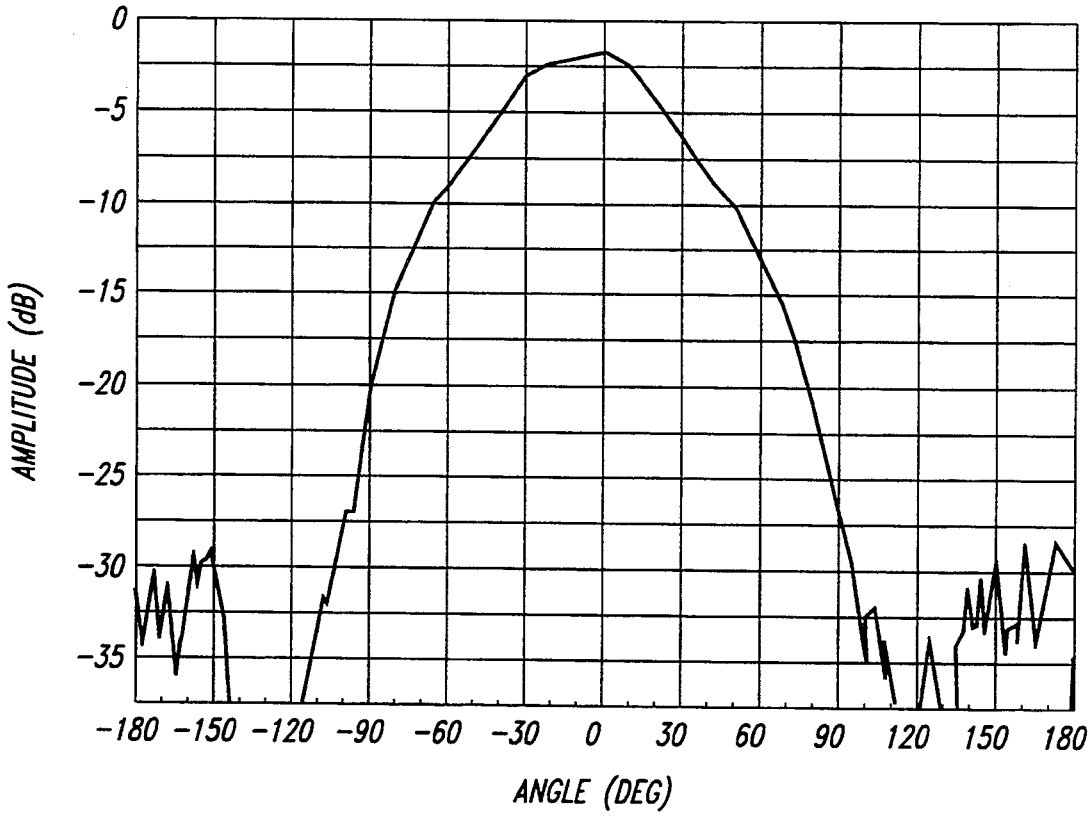
FIG. 9B is an azimuth (yaw-plane) coverage radiation pattern of the present invention.

FIGS. 9A and 9B are graphs of the antenna pattern of the first embodiment of the present invention. FIG. 9A shows the antenna pattern in the pitch-plane of the aircraft, while FIG. 9B shows the antenna pattern in the yaw-plane of the aircraft. The shape of the main beam pattern is virtually unchanged as the frequency varies over a factor of 2.

Figure 10:
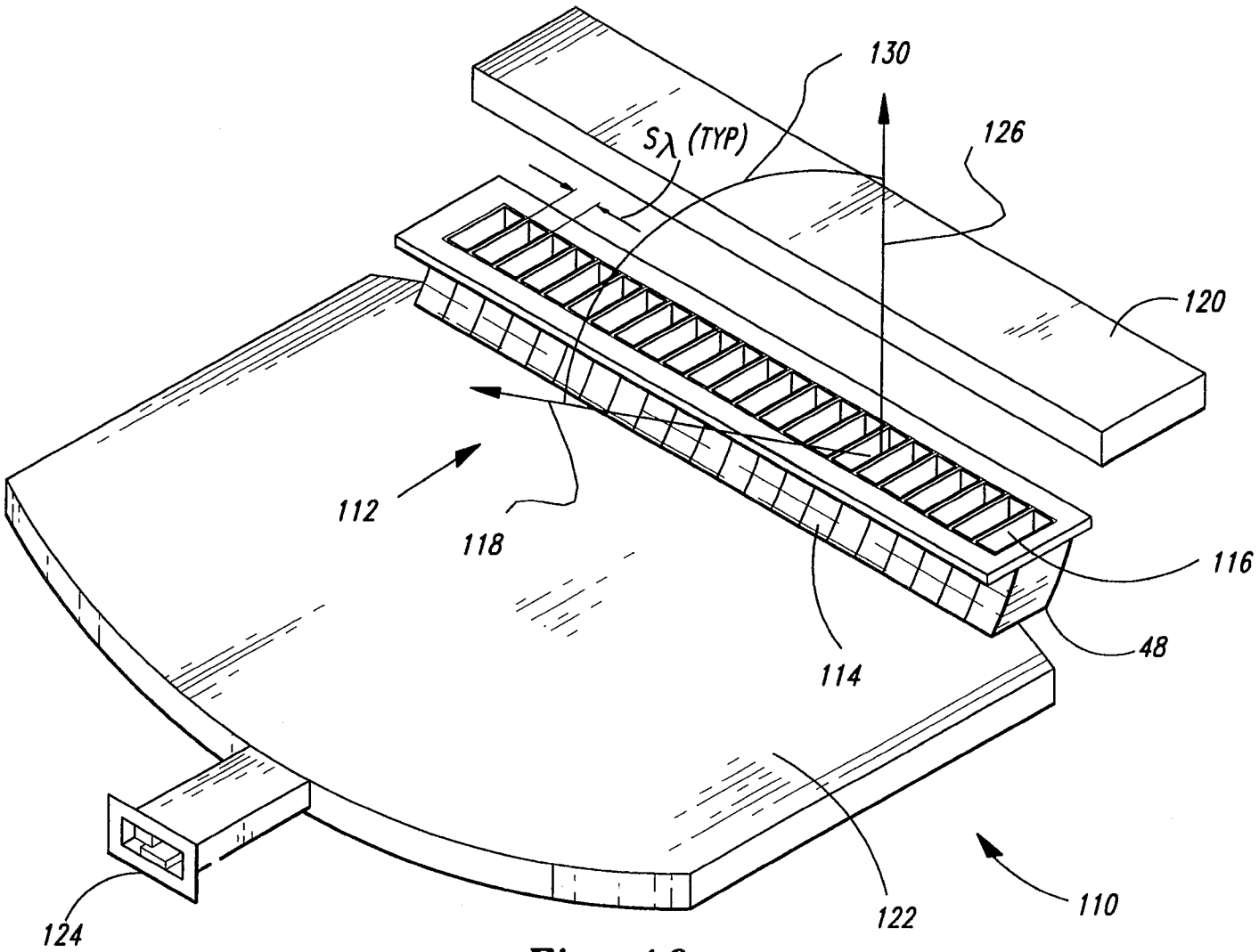
FIG. 10 is a perspective drawing of a second embodiment of the invention.

FIG. 10 is an isometric drawing of a second embodiment of the present invention. The antenna array 110 includes a linear array 112 composed of individual waveguide elements 114. Each of the waveguide elements has an output end 116 and an input end 118. The linear array 112 can be covered by a cover 120. The cover 120 not only conforms to the shape of the fuselage 24 of the airborne craft (see FIG. 1) to minimize aerodynamic drag, but also protects the interior of each of the waveguide elements 114 from damage due to the atmosphere. A transmission line 121 is connected between the input end 118 of each of the waveguide elements 114 and the Gent lens 122. The Gent lens is fed via the beam port 124, as described above. If desired, more than one beam port 124 can be operated in connection with the Gent lens 122.

Figure 11B:
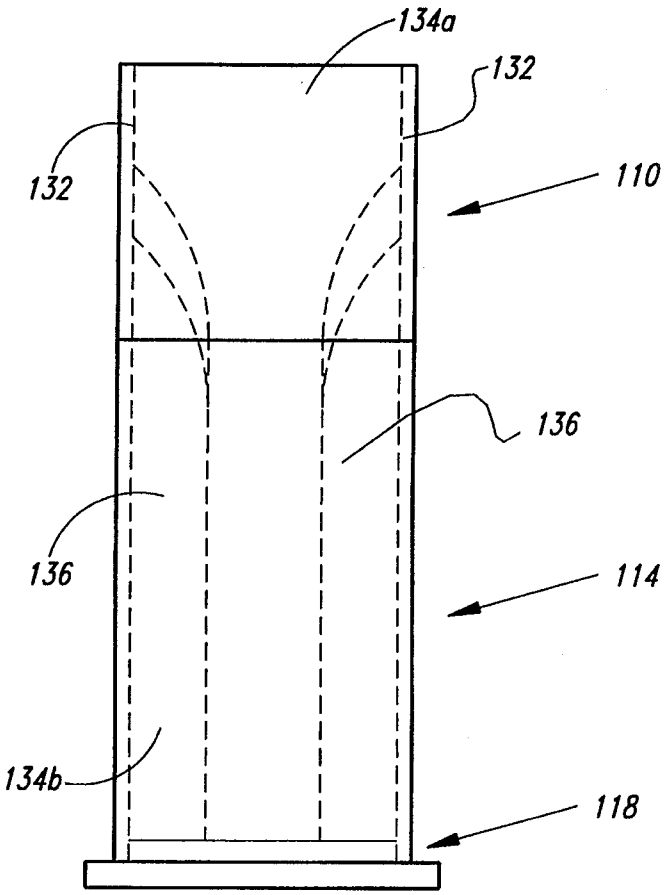
FIG. 11B is a side view of an asymmetrical double ridged waveguide of the second embodiment of the present invention, taken in the direction of the magnetic (H-) plane.
Figure 11A:
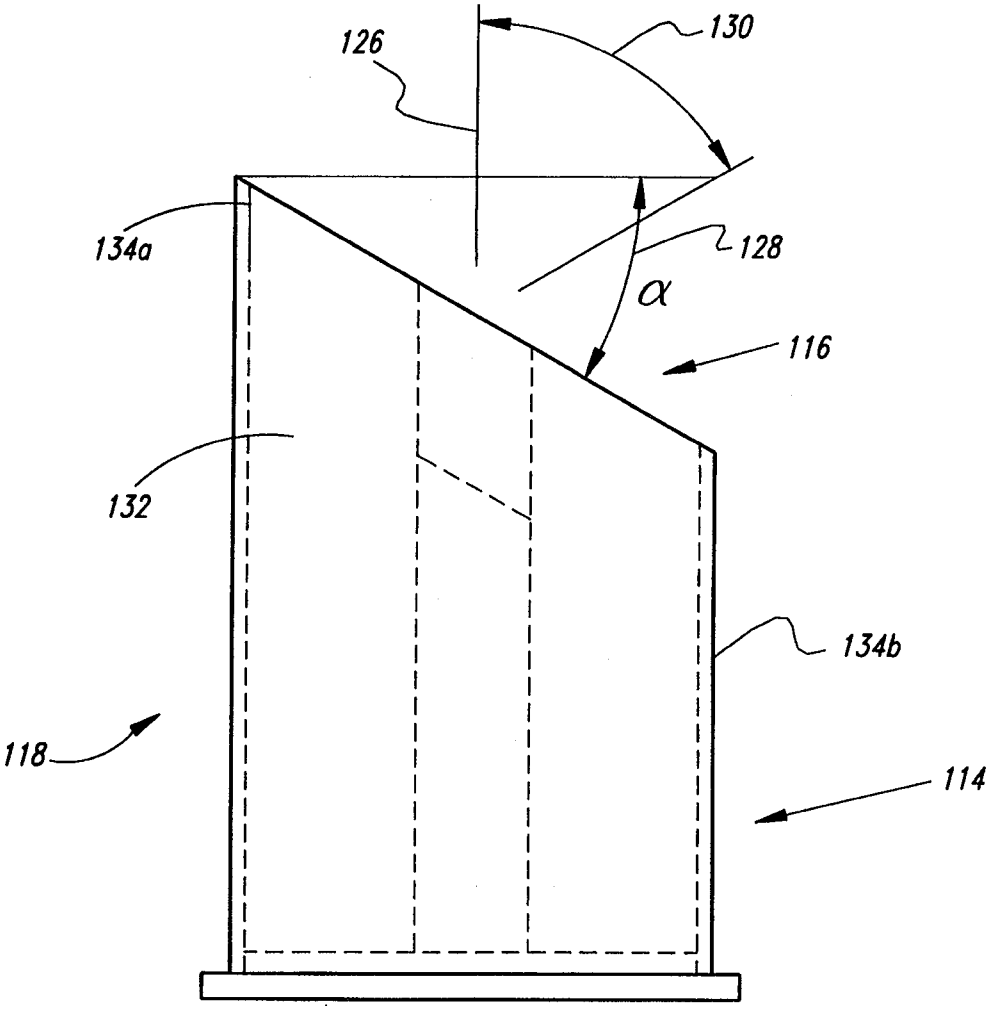
FIG. 11A is a front view of an asymmetric double ridged waveguide of the second embodiment of the present invention, taken in the direction of the magnetic (H-) plane.

FIGS. 11A and 11B are front and side views of an individual double-ridged waveguide element 114 of the antenna array 110 shown in FIG. 10. Each of the double-ridged waveguide elements 114 has a boresight axis 126 (also shown in FIG. 10). Each of the double-ridged waveguide elements 114 is tapered in the direction of the H-plane at a taper angle 128, and the linear array 112 can transmit a beam of the electromagnetic energy at a scan angle of 30 in the yaw-plane (see FIGS. 10 and 11A), which is measured with respect to the boresight axis 126.

The double-ridged waveguide element 114 has an essentially rectangular cross-sectional area defined by two pairs of parallel walls. A first pair of walls 132 is separated from one another in the E-plane direction. Another pair of waveguide walls, **134*a* and 134*b*, is separated in the H-plane. The waveguide wall 134*a* is longer than the waveguide wall 134*b*. Each of the waveguide walls 132 tapers between the waveguide wall 134*a* and the waveguide wall 134*b* at the taper angle 128. If desired, dielectric inserts 136 can be placed in the waveguide elements 114** in order to affect the antenna pattern each produces.

Figure 12A:
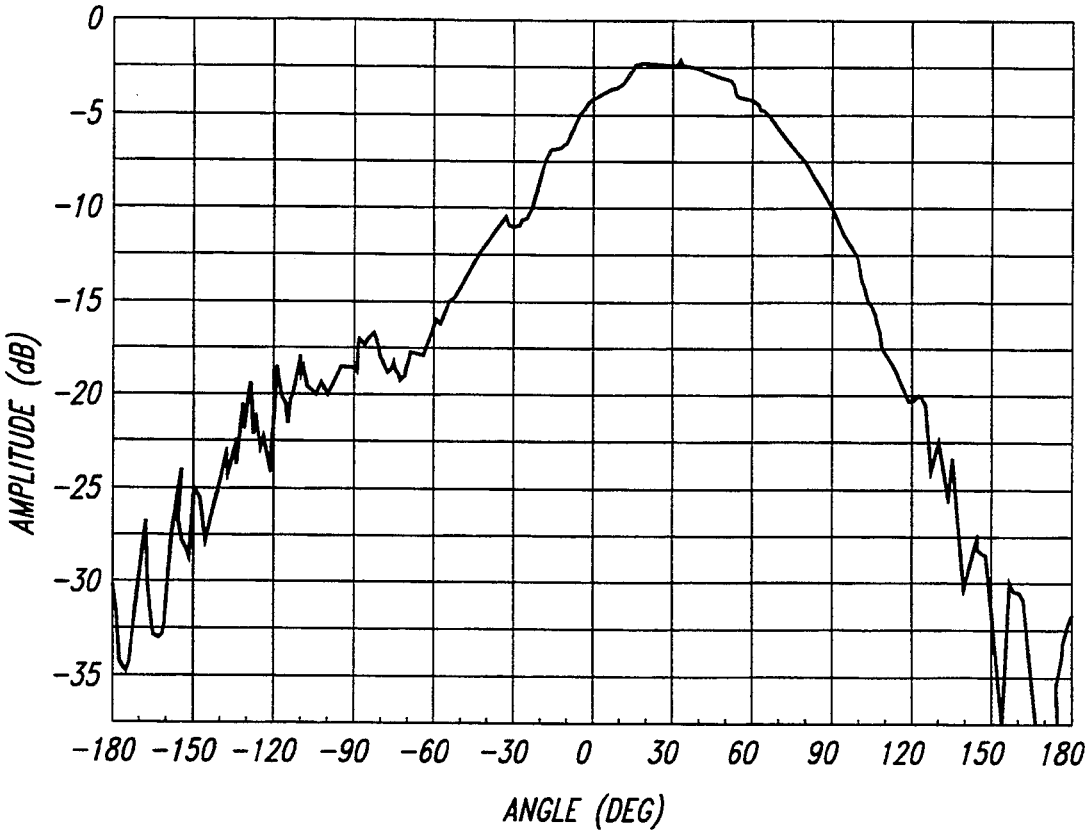
FIG. 12A is an antenna radiation pattern of the asymmetrical H-plane cut double-ridged waveguide antenna element of the second embodiment of the present invention, taken in the H-plane at a first frequency.
Figure 12B:
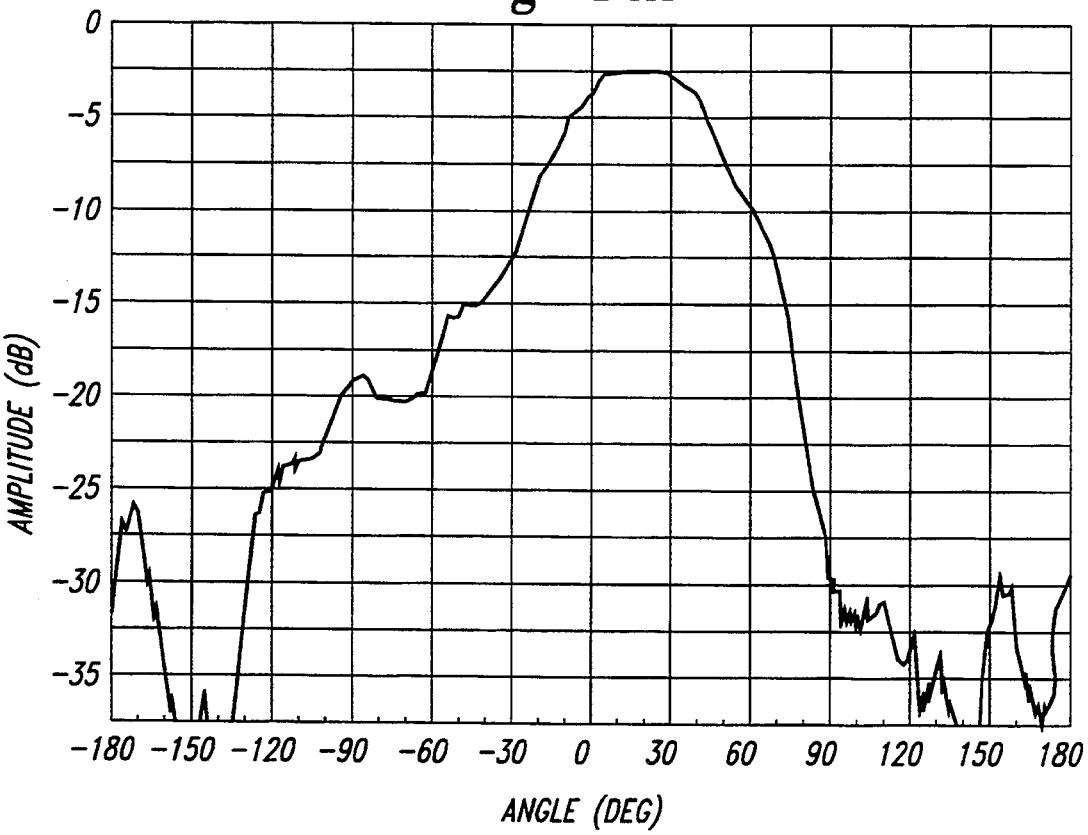
FIG. 12B is an antenna radiation pattern of the asymmetrical H-plane cut double-ridged waveguide antenna element of the second embodiment of the present invention, taken in the H-plane at a second frequency, one octave higher than the first frequency.

FIGS. 12A and 12B are antenna patterns of the second embodiment of the present invention taken at two different frequencies. Both antenna radiation patterns are taken in the H-plane. The H-plane radiation patterns at the two frequencies are substantially the same, even though the higher frequency (shown in FIG. 12B) is approximately twice the frequency at which the radiation pattern of FIG. 12A is taken. Accordingly, the antenna array 110 is substantially frequency insensitive, as is desired.

Figure 13:
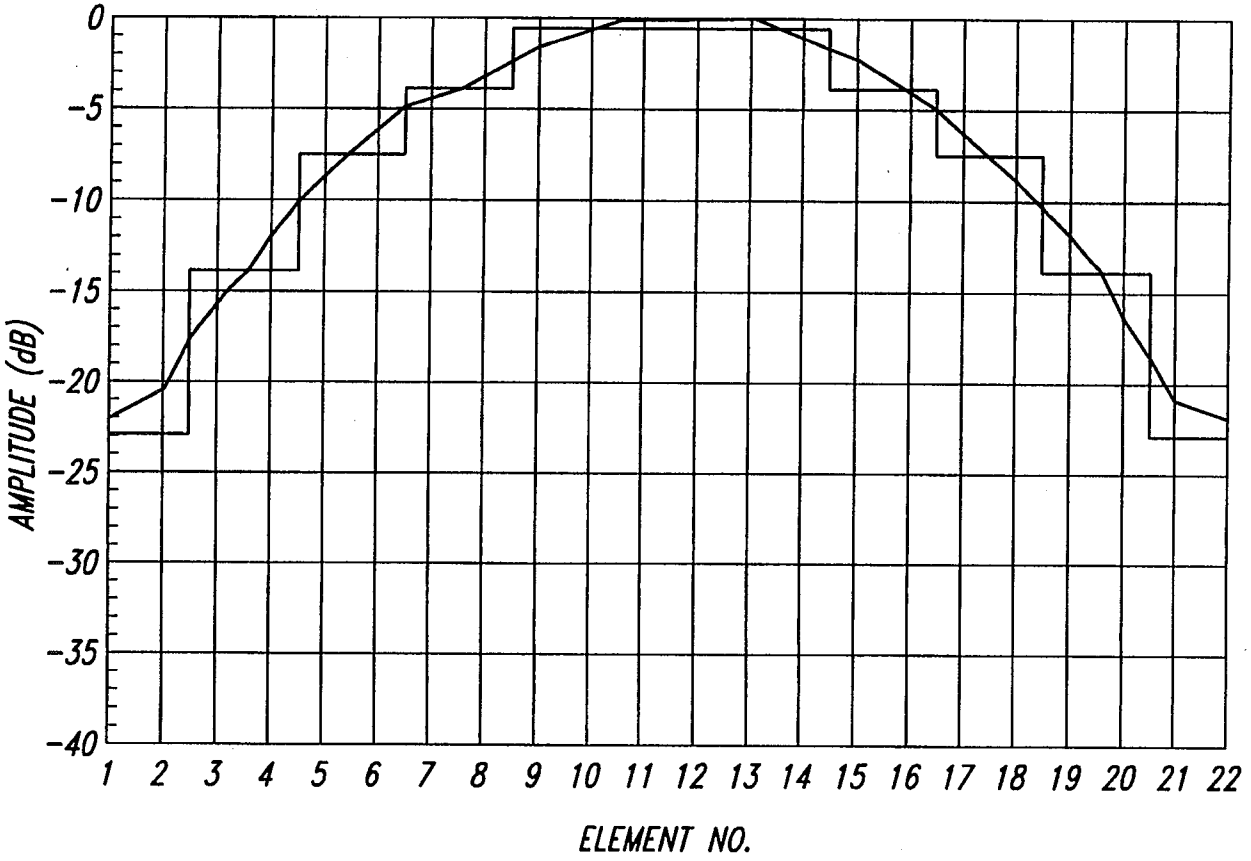
FIG. 13 is a graph of an amplitude distribution which is useful with the second embodiment of the present invention.

If the transmission means 122 (shown in FIG. 10) is a Gent lens, it includes attenuators, similar to attenuators 110 shown in FIG. 7A, which can be used to control the amplitude distribution of the E-plane antenna pattern produced by the antenna array 110. The amplitude distribution shown in FIG. 13 produces first side lobes which are approximately 45 dB below the main lobe of the radiation pattern produced by the antenna array 110.

Figure 14A:
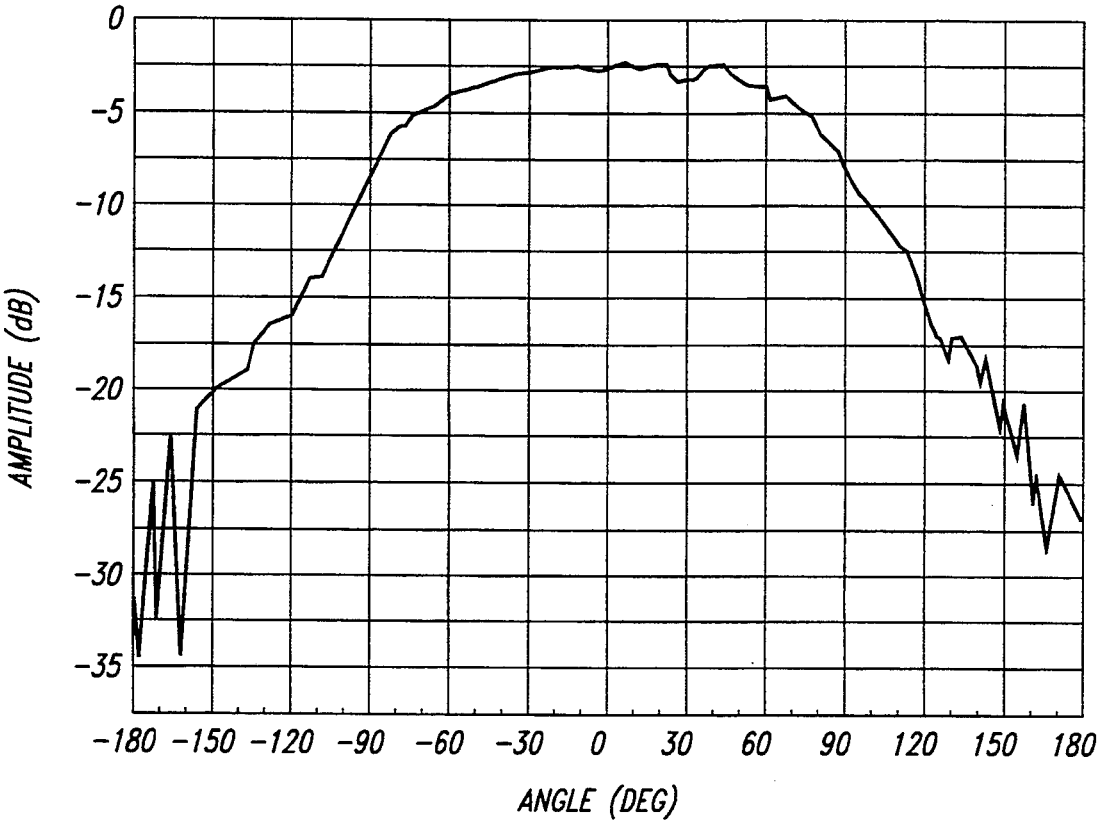
FIG. 14A is a graph of the electric field plane (roll-plane) antenna radiation pattern of the second embodiment of the present invention at a first frequency.
Figure 14B:
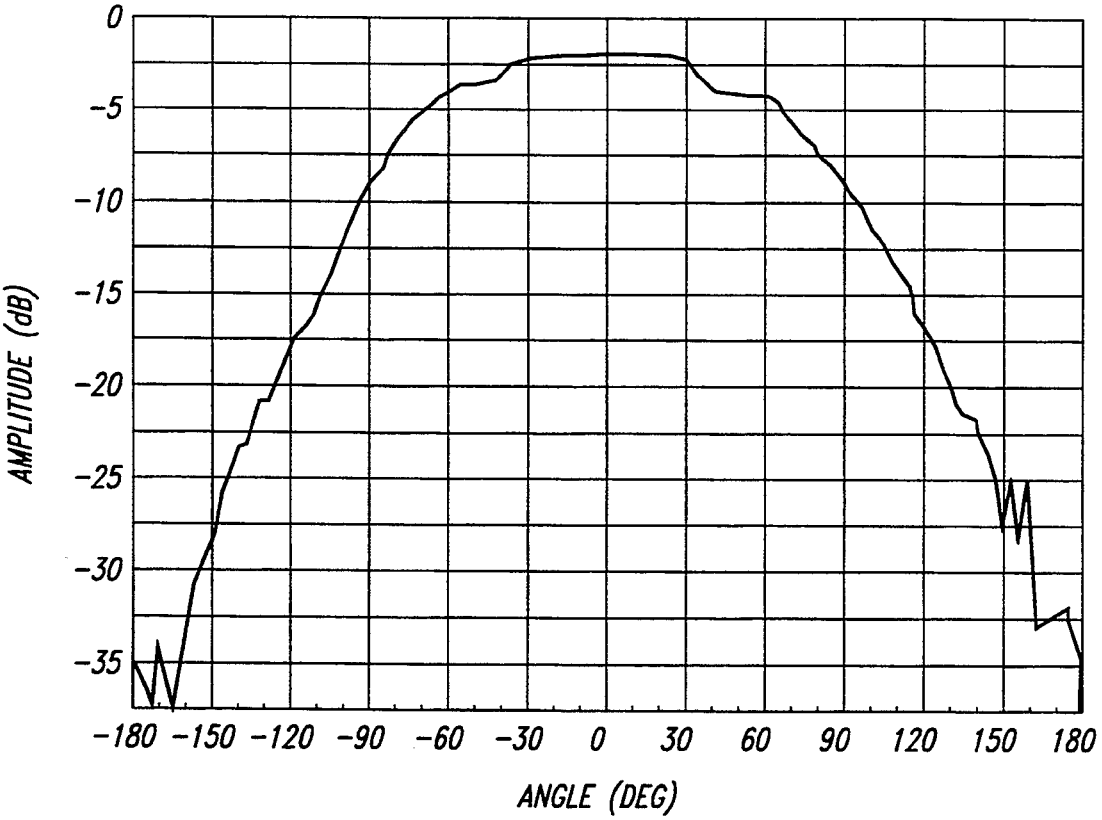
FIG. 14B is a graph of the electric field plane (roll-plane) antenna radiation pattern of the second embodiment of the present invention at a second frequency, which is one octave higher than the first frequency.

As shown in FIGS. 14A and 14B, the antenna array 110 has a very wide bandwidth, since the E-plane radiation patterns shown in FIG. 14A and 14B are substantially identical, even though the frequency increases by a factor of 2 between FIGS. 14A and 14B.

Figure 15:
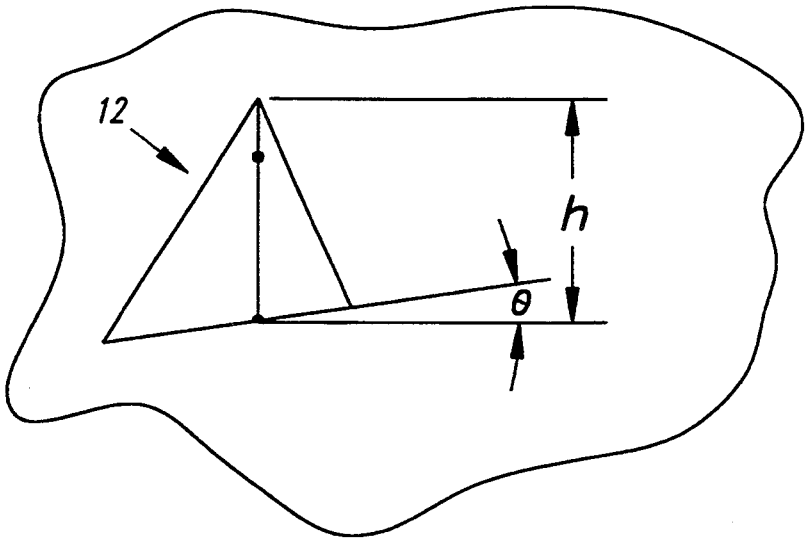
FIG. 15 is a graph of the yaw-plane radiation pattern according to a second embodiment of the present invention, taken in the direction of the magnetic field plane (H-plane).

FIG. 15 is a top view (yaw-plane cut) of a waveguide element or array according to a second embodiment of the present invention, taken in the direction of the magnetic field plane.

While the foregoing has been a discussion of two specific embodiments of the present invention, those skilled in the art will appreciate that numerous modifications to the disclosed embodiments can be made without departing from the spirit and scope of the invention. Accordingly, the invention is to be limited only by the following claims.

We claim:

1. An antenna, comprising a plurality of rectangular waveguide antenna elements each having an input end, an output end, and first and second mutually orthogonal pairs of parallel walls, the output ends of the second walls of each of said antenna elements being generally tapered inwardly toward the input end of said antenna elements from one of said first walls to the other of said first walls along a first axis extending perpendicularly from one of said first walls to the other, said antenna elements being arranged in a row having a longitudinal axis with the first walls of all of said antenna elements being generally parallel to each other and with the first axis of each of said antenna elements generally aligned with each other along the longitudinal axis of said row.

2. The antenna of claim 1, further comprising transmitting means connected to said input ends of said antenna elements for transmitting electromagnetic energy to said antenna elements.

3. The antenna of claim 1 wherein the electromagnetic energy comprises electric fields that extend generally between said first walls.

4. The antenna of claim 1, further comprising transmitting means connected to said input ends of said antenna elements for transmitting electromagnetic energy to said antenna elements.

5. The antenna of claim 4 wherein said transmitting means comprises means for independently controlling the amplitude of the electromagnetic energy transmitted to each of said antenna elements.

6. The antenna of claim 4 wherein said transmitting means comprises means for independently controlling the phase of the electromagnetic energy transmitted to each of said antenna elements.

7. The antenna of claim 4 wherein said transmitting means comprises means for independently transmitting electromagnetic energy produced by a plurality of sources of electromagnetic energy to said antenna elements and for controlling the phase of the electromagnetic energy transmitted to each of said antenna elements.

8. The antenna of claim 1 wherein the output ends of said antenna elements are planar.

9. The antenna of claim 1 wherein each of said antenna elements includes a ridge formed on each of said first walls adjacent the output end thereof.

10. A transmission system, comprising:

a plurality of rectangular waveguide antenna elements each having an input end, an output end, and first and second mutually orthogonal pairs of parallel walls, the output end of each second wall of each of said antenna elements being generally tapered inwardly toward the input end thereof from one of said first walls to the other of said first walls in a first direction extending perpendicularly from one of said first walls to the other, said antenna elements being arranged in a row extending in said first direction with the first walls of said antenna elements being generally parallel to each other;

transmitting means connected to said input ends of said antenna elements for transmitting electromagnetic energy to said antenna elements; and means for independently controlling the phase of the electromagnetic energy transmitted to each of said antenna elements, whereby said each of said antenna elements independently direct said electromagnetic energy in a predetermined.

11. The transmission system of claim 10 wherein said transmitting means is a Gent lens having a separate connection to each said antenna element.

12. The transmission system of claim 10 wherein the output ends of said antenna elements are planar.

13. An airborne craft for transmitting electromagnetic energy in a predetermined direction relative to a longitudinal direction of the airborne craft, the airborne craft comprising:

a fuselage; and an antenna conformal to the fuselage, the antenna including a plurality of rectangular waveguide antenna elements each having an input end, an output end, and first and second mutually orthogonal pairs of parallel walls, the output end of each second wall of each of said antenna elements being generally tapered inwardly toward the input end thereof from one of said first walls to the other of said first walls in a first direction extending perpendicularly from one of said first walls to the other, said antenna elements being arranged in a row with the first walls of all said antenna elements being generally parallel to each other and with the first direction of each of said antenna elements facing in substantially the same direction along the longitudinal axis of said row.

14. The airborne craft of claim 13, further comprising transmitting means connected to said input ends of said antenna elements for transmitting electromagnetic energy to said antenna elements.

15. The airborne craft of claim 14 wherein the electromagnetic energy comprises electric fields that extend between the first walls of said antenna elements.

16. The airborne craft of claim 14 wherein said transmitting means comprises means for independently controlling the amplitude of the electromagnetic energy transmitted to each of said antenna elements.

17. The airborne craft of claim 14 wherein said transmitting means comprises means for independently controlling the phase of the electromagnetic energy transmitted to each of said antenna elements.

18. The airborne craft of claim 14 wherein said transmitting means comprises means for independently transmitting electromagnetic energy produced by a plurality of sources of electromagnetic energy to said antenna elements and for controlling the phase of the electromagnetic energy transmitted to each of said antenna elements.

19. The airborne craft of claim 14 wherein said transmitting means is a Gent lens having a separate connection to each said antenna element.

20. The airborne craft of claim 19 wherein said Gent lens includes phase correcting microstrip transmission lines, and fixed value attenuators.

21. The airborne craft of claim 13 wherein the output ends of said antenna elements are planar.

* * * * *

UNITED STATES PATENT AND TRADEMARK OFFICE

CERTIFICATE OF CORRECTION

PATENT NO. : 5,359,338

DATED : October 25, 1994

INVENTOR(S) : Eugene C. Hatcher, Jr. et al.

It is certified that error appears in the above-identified patent and that said Letters Patent is hereby corrected as shown below:

Column 10, claim 10, line 24, after "predetermined" and before"." insert --direction--.

Signed and Sealed this

Seventh Day of March, 1995

Bruce Lehman

*Attest:*

BRUCE LEHMAN

*Attesting Officer*

*Commissioner of Patents and Trademarks*